US010512970B2

(12) United States Patent
Hanao et al.

(10) Patent No.: US 10,512,970 B2
(45) Date of Patent: Dec. 24, 2019

(54) METHOD FOR CONTINUOUSLY CASTING STEEL

(71) Applicant: NIPPON STEEL & SUMITOMO METAL CORPORATION, Tokyo (JP)

(72) Inventors: Masahito Hanao, Kashima (JP); Hiroaki Uchiyama, Tokai (JP); Kohei Fujimoto, Tokai (JP); Masatoshi Miyahara, Yachiyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/255,904

(22) Filed: Jan. 24, 2019

(65) Prior Publication Data

US 2019/0151937 A1 May 23, 2019

Related U.S. Application Data

(62) Division of application No. 15/535,439, filed as application No. PCT/JP2016/060769 on Mar. 31, 2016, now Pat. No. 10,259,037.

(30) Foreign Application Priority Data

Mar. 31, 2015 (JP) ..... 2015-072279

(51) Int. Cl.
*B22D 11/04* (2006.01)
*B22D 11/041* (2006.01)
(Continued)

(52) U.S. Cl.
CPC ..... *B22D 11/115* (2013.01); *B22D 11/04* (2013.01); *B22D 11/041* (2013.01); *B22D 11/11* (2013.01); *B22D 11/18* (2013.01)

(58) Field of Classification Search
CPC ..... B22D 11/04; B22D 11/041; B22D 11/115; B22D 11/18; B22D 11/186
See application file for complete search history.

(56) References Cited

U.S. PATENT DOCUMENTS 5,730,207 A * 3/1998 Pleschiutschnigg ..... B22D 11/0408 164/418
2002/0157808 A1 10/2002 Shibata
(Continued)

FOREIGN PATENT DOCUMENTS

EP 1195211 A1 * 4/2002 ..... B22D 11/10
JP 06-142865 5/1994
(Continued)

OTHER PUBLICATIONS

Xi-Yan Tian et al., "Electromagnetic Brake Effects . . . New Type Magnet", Metallurgical and Materials Transactions B, vol. 40, No. 4, May 28, 2009, pp. 596-604.

*Primary Examiner* — Kevin E Yoon
(74) *Attorney, Agent, or Firm* — Clark & Brody

(57) ABSTRACT

A primary object of the present invention is to provide a technique of avoiding occurrence of surface defects caused by an electromagnetic brake while checking internal defects with this electromagnetic brake, so that cleanliness of a cast steel can be improved compared with prior arts, and the present invention provides a method for continuously casting steel, the method comprising supplying molten steel into a funnel mold while applying an electromagnetic brake to an outlet flow discharged from an outlet port of an immersion nozzle, wherein magnetic flux density (B) of the electromagnetic brake is within a range of the following (Formula 1):

$$B_{min} \le B \le B_{max}, \qquad \text{(Formula 1)}$$

$$B_{min} = \frac{800 \cdot \left(\frac{D_{max}}{D_0}\right)^3 \cdot \left(\frac{H_{SEN}}{H_0}\right)}{|(v \cdot \sin\theta)|},$$

(Continued)

-continued and $$B_{max} = \frac{3000 \cdot \left(\frac{D_{max}}{D_0}\right)^3 \cdot \left(\frac{H_{SEN}}{H_0}\right)}{(v \cdot \sin\theta)^2}.$$

4 Claims, 4 Drawing Sheets

(51) Int. Cl.

| | |
|---|---|
| ***B22D 11/115*** | (2006.01) |
| ***B22D 11/18*** | (2006.01) |
| ***B22D 11/11*** | (2006.01) |

(56) References Cited

U.S. PATENT DOCUMENTS

| | | | |
|---|---|---|---|
| 2014/0190655 | A1 | 7/2014 | Toh et al. |
| 2018/0009026 | A1 | 1/2018 | Hanao et al. |

FOREIGN PATENT DOCUMENTS

| | | | | |
|---|---|---|---|---|
| JP | 2002-239691 | | | 8/2002 |
| JP | 2007-105745 | | | 4/2007 |
| JP | 2007319923 | A | * | 12/2007 |
| JP | 2008-183597 | | | 8/2008 |
| JP | 2009-066618 | | | 4/2009 |
| JP | 5245800 | | | 4/2013 |
| KR | 10-2014-0053279 | | | 5/2014 |

* cited by examiner

METHOD FOR CONTINUOUSLY CASTING STEEL

This application is a Divisional of U.S. Ser. No. 15/535,439 filed on Jun. 13, 2017, which is a national phase of PCT/JP2016/060769 filed on Mar. 31, 2016.

TECHNICAL FIELD

The present invention relates to a method for continuously casting steel.

BACKGROUND ART

Continuous casting of steel is carried out while molten metal in a tundish is supplied into a mold of continuous casting equipment via an immersion nozzle. The molten steel is discharged from an outlet port that is formed in a lower end portion of the immersion nozzle, into the mold, is cooled in the mold, and is withdrawn from a mold outlet in the state where a thickness of a solidified shell enough to prevent breakout is ensured. The solidified shell is completely solidified by secondary cooling with spray during the process of withdrawn, and is cut, to be a cast steel.

As a technique of improving the cleanliness of a cast steel, for example, Patent Literature 1 discloses that electromagnetic stirrers are oppositely arranged in the vicinity of a meniscus in long sides of a mold, so that a swirl flow is generated on the surface of molten steel in the mold; the cleaning effect of this swirl flow checks the phenomenon of adhesion of inclusions and bubbles to the surface of the mold, which is a main cause of defects in a cast steel. Patent Literature 2 discloses that an electromagnetic brake is operated on an outlet flow that is discharged from an outlet port of an immersion nozzle, so as to hold down the descending speed of molten steel, to have time for inclusions in the molten steel to float up.

In the technique of the above Patent Literature 1, an electromagnetic brake does not work on an outlet flow discharged from an outlet port of an immersion nozzle. Thus, the descending speed of the outlet flow is not held down. Therefore, bubbles and inclusions such as alumina remaining in molten steel do not float up or are not removed enough, and they infiltrate into a deep portion of the cast steel, to be a cause of internal defects, which is problematic. This problem can be avoided by operating the electromagnetic brake on the outlet flow as the above described Patent Literature 2.

When an electromagnetic brake is operated on an outlet flow, as shown in FIG. 3 (a front cross-sectional view of a mold) and 4 (a side cross-sectional view of the mold), an upward flow along an immersion nozzle 2 is generated. This upward flow turns around near the surface of molten steel, to be a downward flow. Here, specifically, a distance ($D_0$) between long side surfaces of the mold for manufacturing a thin cast steel is short. Therefore, inclusions and bubbles carried by the downward flow are easy to be in contact with a solidified shell 8 that is formed on long side walls 3*a* and 3*b* composing long sides of the mold, and caught here, to be a main cause of surface defects, which is a new problem.

CITATION LIST

Patent Literature

Patent Literature 1: JP2008-183597A
Patent Literature 2: JP5245800B

SUMMARY OF INVENTION

Technical Problem

An object of the present invention is to solve the above described conventional problems, and to provide a technique of avoiding occurrence of surface defects caused by an electromagnetic brake while checking internal defects with this electromagnetic brake, so that cleanliness of a cast steel can be improved compared with prior arts.

Solution to Problem

To solve the above problems, the present invention provides a method for continuously casting steel, the method comprising supplying molten steel into a mold while applying an electromagnetic brake to an outlet flow discharged from an outlet port of an immersion nozzle, wherein magnetic flux density (B) of the electromagnetic brake is within a range of the following (Formula 1):

$$B_{min} \leq B \leq B_{max} \quad \text{(Formula 1)}$$

wherein $$B_{min} = \frac{800 \cdot \left(\frac{D_{max}}{D_0}\right)^3 \cdot \left(\frac{H_{SEN}}{H_0}\right)}{(v \cdot \sin\theta)},$$

$$B_{max} = \frac{3000 \cdot \left(\frac{D_{max}}{D_0}\right)^3 \cdot \left(\frac{H_{SEN}}{H_0}\right)}{(v \cdot \sin\theta)^2},$$

$D_0$=a mold thickness (m) of the mold having short sides and the long sides on a horizontal cross-sectional shape, the mold thickness measured as a distance between the long sides facing each other in the mold at ends of the long sides, $D_{max}$=a maximum value of a mold thickness (m) of the mold having the short sides and the long sides on the horizontal cross-sectional shape, the maximum value measured as a distance between the long sides facing each other in the mold at a middle of each long side, $H_0$=a distance (m) between a surface of the molten steel and a center of an electromagnetic brake coil in a vertical direction, $H_{SEN}$=a distance (m) between a bottom surface of the immersion nozzle and the center of the electromagnetic brake coil in the vertical direction, v=a flow velocity (m/s) of the molten steel discharged from the immersion nozzle, and θ=an outlet flow angle (°) of the molten steel obtained as an angle formed with a horizontal line where an upward direction is a positive.

In the present invention, a rectangular mold that has short sides and long sides on a horizontal cross-sectional shape can be used as the mold.

In the present invention wherein a rectangular mold is used as the mold, preferably, the flow velocity v of the molten steel is 0.685 m/s to 0.799 m/s. Whereby, an upward flow is gently generated all over, which makes it easy to check generation of a downward flow along a solidification interface.

In the present invention, preferably, a funnel mold with short sides and long sides on a horizontal cross-section, in which a distance between the long sides facing each other in the mold at a middle of each long side is enlarged than a distance between the long sides at ends of the long sides, is used as the mold.

In the present invention wherein a funnel mold is used as the mold, preferably, $D_{max}/D_0$ is 1.16 to 1.24. Whereby, even if inclusions are carried by a downward flow, it is easy to decrease the frequency with which these inclusions are supplied to a solidification interface.

In the present invention wherein a funnel mold is used as the mold, preferably, $H_{SEN}/H_0$ is 0.161 to 0.327. Whereby, an upward flow is gently generated all over, which makes it easy to check generation of a downward flow along a solidification interface.

In the present invention wherein a funnel mold is used as the mold, preferably, the flow velocity v of the molten steel is 0.441 m/s to 1.256 m/s. Whereby, it is easy to stabilize a molten steel flow in the mold, and to check fluctuation on the surface of the molten steel.

In the present invention, preferably, the outlet flow angle θ of the molten steel is −45° to −5°. Whereby, it is easy to stabilize a molten steel flow in the mold, and to check fluctuation on the surface of the molten steel.

Advantageous Effects of Invention

According to the present invention that employs the structure that magnetic flux density (B) of the electromagnetic brake is within a range of the above described (Formula 1) in the method for continuously casting steel, the method comprising supplying molten steel into a mold while applying an electromagnetic brake to an outlet flow discharged from an outlet port of an immersion nozzle, occurrence of surface defects caused by the electromagnetic brake can be efficiently avoided even if the mold for manufacturing a thin cast steel is used, while the effect of the electromagnetic brake which is to hold down the descending speed of the molten steel and to reduce internal defects in the cast steel is enjoyed.

That is, according to the present invention, both internal defects in the mold and surface defects can be surely reduced, and the cleanliness of the cast steel can be improved with an extremely easy method of having the electromagnetic brake of proper magnetic flux density in accordance with the above (Formula 1).

DESCRIPTION OF EMBODIMENTS

A preferred embodiment of the present invention will be described hereinafter.

Figure 1:
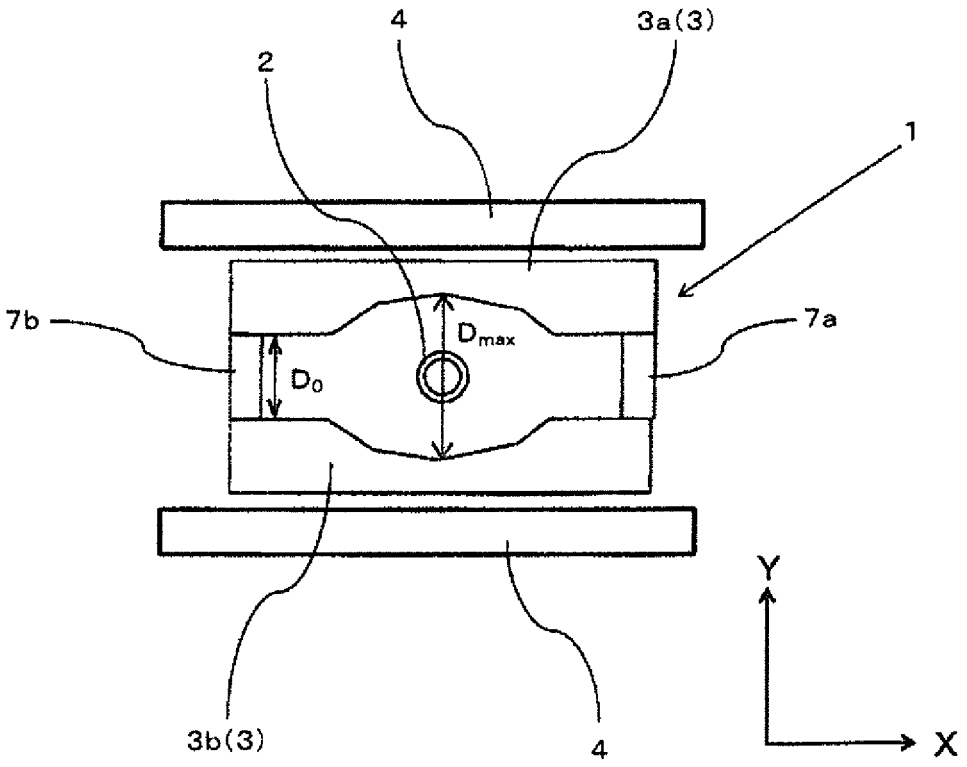
FIG. 1 is a schematically explanatory view of a plane showing an outline of structure in the vicinity of a mold of a continuous-casting apparatus in one embodiment of the present invention.
Figure 2:
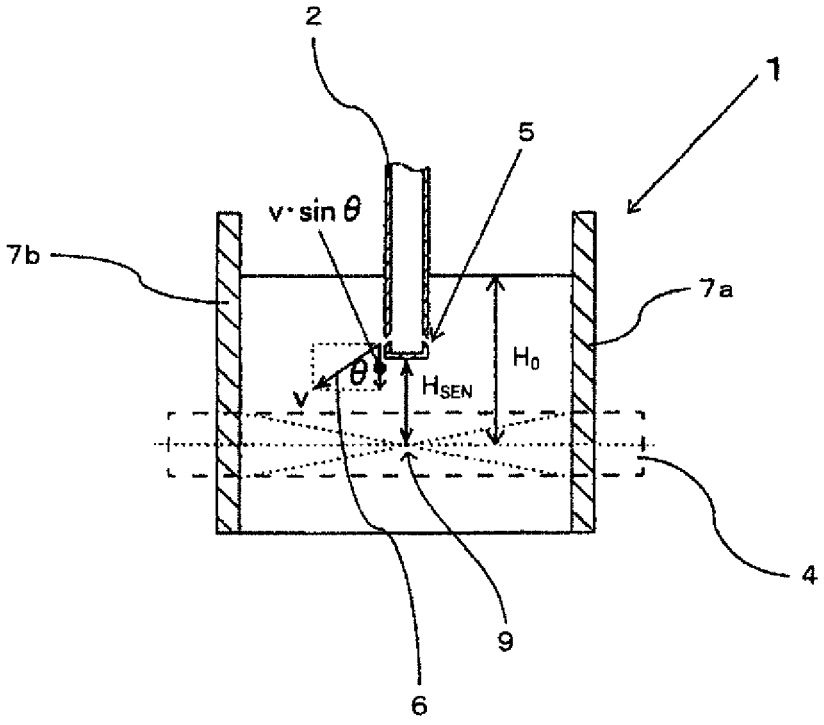
FIG. 2 is a schematically explanatory view of a front cross-section showing an outline of structure in the vicinity of the mold of the continuous-casting apparatus in one embodiment of the present invention.

In this embodiment, as shown in FIG. 1, an immersion nozzle 2 is arranged around the middle from the long and short sides of a mold 1 whose horizontal cross-sectional shape is almost rectangular. As shown in FIG. 2, an electromagnetic brake device 4 is oppositely arranged so that the mold 1 is sandwiched therein, outside long side walls 3 that compose long sides of the mold 1, at a position downward from the lower end of the immersion nozzle 2.

In this embodiment, as shown in FIG. 1, a funnel mold with short sides and long sides on a horizontal cross-section, in which a distance between the long sides facing each other in the mold at a middle of each long side is enlarged than a distance between the long sides at ends of the long sides, is used as the mold. Other than this, in the present invention, a rectangular mold where $D_{max}=D_0$ can be used. Here, satisfaction of $D_{max}>D_0$ can make a swirl flow around the surface of the molten steel in the horizontal direction stable. In addition, a solidification shell is kept away from a downward flow that is generated by turning-around near the surface of the molten steel, thereby the occasions of catching inclusions and bubbles can be decreased.

An outlet port 5 from which molten steel is discharged in the mold 1 diagonally downward is formed on each portion of the immersion nozzle 2 which faces short side walls 7*a* and 7*b* of the mold 1 respectively. Bubbles of an Ar gas, and alumina and slag-type inclusions are contained in an outlet flow 6 discharged from the outlet port 5 because an Ar gas is blew into the immersion nozzle 2.

In this embodiment, the electromagnetic brake device 4 is oppositely arranged so that the mold 1 is sandwiched therein, at a position downward from the lower end part of the immersion nozzle 2 in order to avoid the phenomenon that those bubbles of Ar gas, and alumina and slag-type inclusions infiltrate into a deep portion of the cast steel, to be internal defects while not floating up or removed enough in the mold 1.

The electromagnetic brake device 4 is composed of an electromagnet etc. The electromagnetic brake device 4 can apply a DC magnetic field to the outlet flow 6 just after discharged from the outlet port 5 of the immersion nozzle 2, in the mold thickness direction (Y direction in FIG. 1) along the short side walls 7*a* and 7*b* of the mold 1. This DC magnetic field has almost uniform magnetic flux density distribution in all the mold width direction (X direction in FIG. 1) along the long side walls 3*a* and 3*b* of the mold 1. An induced current in the X direction in FIG. 1 is generated by this DC magnetic field and outlet flow. A counterflow that flows in the opposite direction to the outlet flow 6 is formed in the vicinity of the outlet flow 6 by this induced current and the DC magnetic field, to hold down the descendent speed of the molten steel. Whereby, the phenomenon that bubbles and inclusions such as alumina remaining in the molten steel infiltrate into a deep part of the cast steel while not floating up or removed enough can be avoided.

Figure 3:
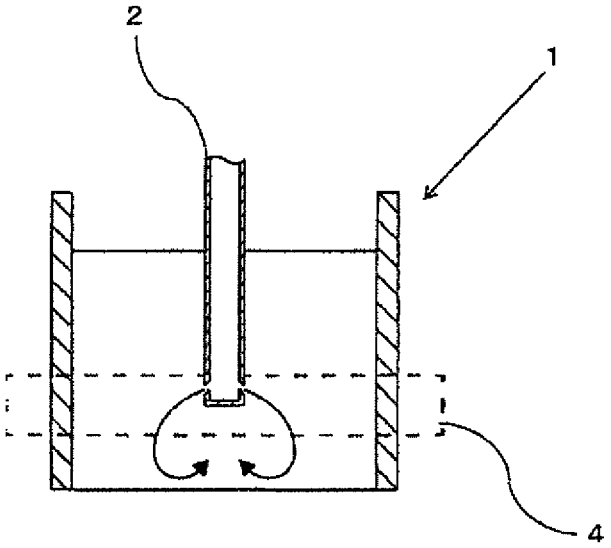
FIG. 3 is an explanatory front cross-sectional view of a state of a molten steel flow in the mold when an electromagnetic brake is operated.
Figure 4:
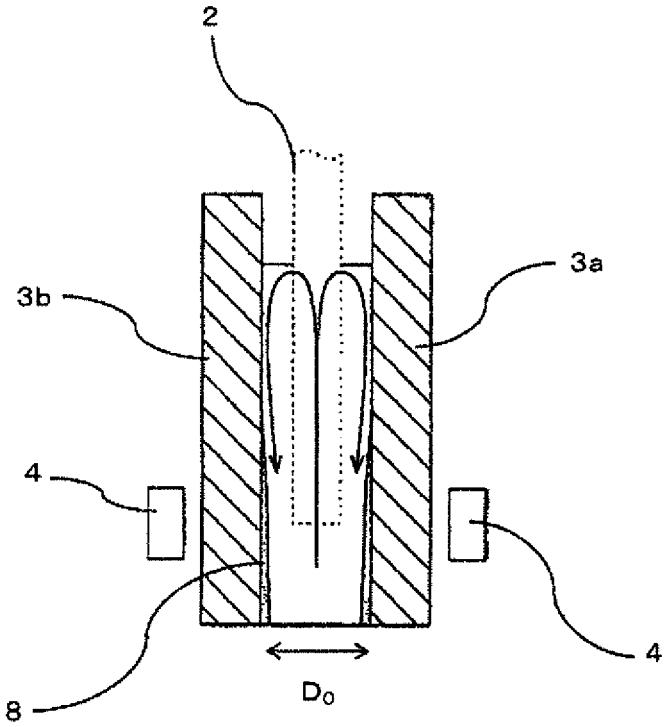
FIG. 4 is an explanatory side cross-sectional view of a state of the molten steel flow in the mold when the electromagnetic brake is operated.

When an electromagnetic brake is operated on an outlet flow in a conventional art, as shown in FIGS. 3 and 4, an upward flow along the immersion nozzle 2 is generated. This upward flow turns around near the surface of the molten steel, to be a downward flow. Especially, in a mold where $D_0$ is about no more than 400 mm, inclusions and bubbles carried by this downward flow are easy to be in contact with a solidified shell 8 on the long side walls 3*a* and 3*b*, and caught, to tend to be a main cause of surface defects, which is problematic. In contrast, in the present invention, the phenomenon that inclusions and bubbles carried by the downward flow are caught by the solidified shell 8 on the long side walls 3*a* and 3*b* can be checked by having the electromagnetic brake of proper magnetic flux density in accordance with the above (Formula 1).

The above (Formula 1) was obtained through inventors' various studies. The effect of the present invention is brought about only with the combination of all the elements composing the above (Formula 1). Here, $B_{min}$ is the lower limit of a proper range of the magnetic flux density of the electromagnetic brake. If the magnetic flux density is under this lower limit, it cannot be prevented that inclusions and bubbles are carried by the outlet flow, to infiltrate downward. $B_{max}$ is the upper limit of a proper range of the magnetic flux density of the electromagnetic brake. If the magnetic flux density is over this upper limit, the upward flow along the immersion nozzle 2 becomes too strong, and thus, the downward flow turning around according to this also becomes strong. Therefore, the frequency with which inclusions and bubbles carried by this downward flow are in contact with the solidified shell 8 becomes high. As a result, surface defects are easy to occur. $B_{min}$ and $B_{max}$ are defined by the combination of some factors that influence flows in the mold.

Specifically, both internal defects in the mold and surface defects can be reduced, and the cleanliness of the cast steel can be improved only with the combination of a mold thickness (m) of the mold having short sides and the long sides on a horizontal cross-sectional shape, the mold thickness measured as a distance between the long sides facing each other in the mold at ends of the long sides ($D_0$), a maximum value of a mold thickness (m) of the mold having the short sides and the long sides on the horizontal cross-sectional shape, the maximum value measured as a distance between the long sides facing each other in the mold at a middle of each long side ($D_{max}$), a distance (m) between a surface of the molten steel and a center of an electromagnetic brake coil in a vertical direction ($H_0$), a distance (m) between a bottom surface of the immersion nozzle and the center of the electromagnetic brake coil in the vertical direction ($H_{SEN}$), a flow velocity (m/s) of the molten steel discharged from the immersion nozzle (v), and an outlet flow angle (°) of the molten steel (θ), so as to satisfy the above (Formula 1).

The smaller the value of $H_{SEN}$ is, the stronger breaking force of the electromagnetic brake to the outlet flow is. Thus, the descendent speed of the outlet flow is held down, and the velocity of the upward flow shown in FIGS. 3 and 4 becomes high. As a result, the velocity of the downward flow that is formed by the upward flow turning around near the surface of the molten steel also becomes high. Therefore, the probability that inclusions and bubbles carried by this downward flow are in contact with the solidified shell 8 on the long side walls 3*a* and 3*b* of the mold, and caught, to be surface defects becomes high.

On the other hand, if the value of $H_{SEN}$ is large so as to approach $H_0$, the effect of the electromagnetic brake weakens, and in addition, fluctuation of the surface of the molten steel becomes large. As a result, involvement of mold powder is easy to occur.

A larger value of θ necessitates breaking force by the larger electromagnetic brake. The upward flow also tends to be large.

As described above, increase and decrease of each variable in the above (Formula 1) brings about different effects. Thus, conventionally, it is difficult to determine proper magnetic flux density of the electromagnetic brake in continuous-casting equipment configured by the combination of them whenever the size of a mold, the casting speed, an immersion nozzle, etc. are changed. In contrast, according to the present invention, both internal defects in the mold and surface defects can be surely reduced, and the cleanliness of the cast steel can be improved with an extremely easy method of having the electromagnetic brake of proper magnetic flux density in accordance with the above (Formula 1).

In the present invention, in a case where the mold is a rectangular mold where $D_{max}=D_0$, the flow velocity of the molten steel v discharged from the immersion nozzle is preferably 0.685 m/s to 0.799 m/s. The flow velocity of the molten steel v of no less than 0.685 m/s makes it easy to obtain the molten steel flow for checking inclusions to be caught by a solidification interface. The flow velocity of the molten steel v of no more than 0.799 m/s makes it easy to check fluctuation on the surface of the molten steel.

On the other hand, in the present invention, in a case where the mold is a funnel mold, $D_{max}/D_0$ is preferably 1.16 to 1.24. $D_{max}/D_0$ of no less than 1.16 makes it easy to gently form the upward flow all over, and to check generation of the downward flow along the solidification interface. $D_{max}/D_0$ of no more than 1.24 makes it easy to reduce the drag when the solidified shell is withdrawn from the mold. In the case where the mold is a funnel mold, $D_{max}/D_0$ is more preferably 1.18 to 1.22 in view of making the above effect outstanding.

In the case where the mold is a funnel mold, preferably, $H_{SEN}/H_0$ is 0.161 to 0.327. $H_{SEN}/H_0$ of no less than 0.161 makes it easy to stabilize heat supply to the surface of the molten steel. $H_{SEN}/H_0$ of no more than 0.327 makes it easy to check fluctuation on the surface of the molten steel. In the case where the mold is a funnel mold, $H_{SEN}/H_0$ is more preferably 0.15 to 0.30 in view of making the above effect outstanding.

In the case where the mold is a funnel mold, preferably, the flow velocity of the molten steel v discharged from the immersion nozzle is 0.441 m/s to 1.256 m/s. The flow velocity of the molten steel v of no less than 0.441 m/s makes it easy to obtain the molten steel flow checking inclusions to be caught, and to supply heat to the surface of the molten steel. The flow velocity of the molten steel v of no more than 1.256 m/s makes it easy to check fluctuation on the surface of the molten steel. In the case where the mold is a funnel mold, more preferably, the flow velocity of the molten steel v is 0.500 m/s to 1.100 m/s in view of making the above effect outstanding.

In the case where the mold is a funnel mold, preferably, an outlet flow angle θ of the molten steel is −45° to −5°. The outlet flow angle θ of the molten steel of no less than −45° makes it easy to supply heat to the surface of the molten steel. The outlet flow angle θ of the molten steel of no more than −5° makes it easy to check fluctuation on the surface of the molten steel. In the case where the mold is a funnel mold, more preferably, the outlet flow angle θ of the molten steel is −45° to −15° in view of making the above effect outstanding.

EXAMPLES

Continuous casting of steel was carried out under the casting conditions shown in Table 1 below, and the quality of produced coils was evaluated. Specifically, the quality of coils was evaluated as follows: visual inspections were done on coils of no less than 50 in each Example, to count sliver defects; and evaluation was made according to the number of defects like: ◎ (excellent: the number of defects ≤0.5/a coil); ○ (good: 0.5/a coil <the number of defects ≤1.0/a coil); and x (poor: the number of defects >1.0/a coil).

TABLE 1

| | | Mold | | | | | Immersion Nozzle | | | | | |
|---|---|---|---|---|---|---|---|---|---|---|---|---|
| | | Shape of Bottom | | Funnel Portion | Electromagnetic Brake | | Distance between | | | $B_{min}$ and $B_{max}$ in Formula 1 Electromagnetic Brake | | |
| | Casting Speed | Width | Thick-ness | Thick-ness | Magnetic Flux Density | Distance between Surface and Center of Coil | Bottom Surface of Nozzle and Center of Coil | Outlet Flow Velocity | Outlet Flow Angle | Proper Strength Range | | Quality |
| | Vc m/min | $W_0$ mm | $D_0$ mm | $D_{max}$ mm | B G | $H_0$ mm | $H_{SEN}$ mm | v m/s | θ deg. | $B_{min}$ G | $B_{max}$ G | of Coils |
| Ex. 1 | 1.4 | 1630 | 250 | 290 | 4100 | 606.5 | 198 | 0.799 | −45 | 722 | 4789 | ◎ |
| Ex. 2 | 1.4 | 1630 | 250 | 310 | 4100 | 606.5 | 198 | 0.799 | −45 | 881 | 5850 | ◎ |
| Ex. 3 | 1.4 | 1630 | 250 | 250 | 4100 | 606.5 | 148 | 0.799 | −30 | 489 | 4587 | ○ |
| Ex. 4 | 1.4 | 1630 | 250 | 290 | 4300 | 606.5 | 148 | 0.799 | −30 | 763 | 7159 | ◎ |
| Ex. 5 | 1.4 | 1630 | 250 | 310 | 4100 | 606.5 | 148 | 0.799 | −30 | 932 | 8745 | ◎ |
| Ex. 6 | 1.4 | 1630 | 255 | 300 | 4100 | 606.5 | 198 | 0.799 | −45 | 799 | 5302 | ◎ |
| Ex. 7 | 1.4 | 1400 | 250 | 300 | 4100 | 606.5 | 198 | 0.686 | −45 | 930 | 7187 | ◎ |
| Ex. 8 | 1.4 | 1150 | 250 | 300 | 4100 | 606.5 | 198 | 0.564 | −45 | 1132 | 10651 | ◎ |
| Ex. 9 | 1.4 | 900 | 250 | 300 | 4100 | 606.5 | 198 | 0.441 | −45 | 1447 | 17390 | ◎ |
| Ex. 10 | 1.0 | 1630 | 250 | 300 | 4100 | 606.5 | 148 | 0.571 | −30 | 1182 | 15534 | ○ |
| Ex. 11 | 1.4 | 1630 | 250 | 300 | 4100 | 606.5 | 148 | 0.799 | −30 | 844 | 7926 | ◎ |
| Ex. 12 | 1.8 | 1630 | 250 | 300 | 1100 | 606.5 | 148 | 1.027 | −30 | 657 | 4795 | ○ |
| Ex. 13 | 1.8 | 1630 | 250 | 300 | 1800 | 606.5 | 148 | 1.027 | −30 | 657 | 4795 | ◎ |
| Ex. 14 | 1.8 | 1630 | 250 | 300 | 4100 | 606.5 | 148 | 1.027 | −30 | 657 | 4795 | ◎ |
| Ex. 15 | 1.8 | 1630 | 250 | 300 | 4400 | 606.5 | 148 | 1.027 | −30 | 657 | 4795 | ◎ |
| Ex. 16 | 1.6 | 1630 | 250 | 300 | 4600 | 606.3 | 148 | 1.027 | −30 | 657 | 4795 | ○ |
| Ex. 17 | 1.0 | 1630 | 250 | 300 | 4100 | 606.5 | 198 | 0.571 | −45 | 1118 | 10391 | ○ |
| Ex. 18 | 1.4 | 1630 | 250 | 300 | 4100 | 606.5 | 198 | 0.799 | −45 | 799 | 5302 | ◎ |
| Ex. 19 | 1.0 | 1630 | 250 | 300 | 4100 | 606.5 | 198 | 0.571 | −30 | 1581 | 20783 | ○ |
| Ex. 20 | 1.4 | 1630 | 250 | 300 | 4100 | 606.5 | 198 | 0.799 | −30 | 1130 | 10603 | ◎ |
| Ex. 21 | 1.8 | 1630 | 250 | 300 | 4100 | 606.5 | 198 | 1.027 | −30 | 879 | 6414 | ◎ |
| Ex. 22 | 2.2 | 1630 | 250 | 300 | 800 | 606.5 | 198 | 1.256 | −30 | 719 | 4294 | ○ |
| Ex. 23 | 1.4 | 1630 | 250 | 300 | 4100 | 606.5 | 98 | 0.799 | −30 | 559 | 5248 | ◎ |
| Ex. 24 | 1.4 | 1630 | 250 | 300 | 4100 | 606.5 | 98 | 0.794 | −15 | 1080 | 19586 | ◎ |
| Ex. 25 | 1.4 | 1630 | 250 | 300 | 4100 | 606.5 | 98 | 0.799 | −5 | 3208 | 172724 | ○ |
| Ex. 26 | 1.0 | 1630 | 300 | 300 | 3000 | 606.5 | 148 | 0.685 | −30 | 570 | 6243 | ○ |
| Ex. 27 | 1.0 | 1630 | 300 | 350 | 1500 | 606.5 | 148 | 0.685 | −30 | 905 | 9914 | ○ |
| Comp. Ex. 1 | 1.4 | 1630 | 250 | 250 | 4100 | 606.5 | 198 | 0.799 | −45 | 462 | 1303 | X |
| Comp. Ex. 2 | 1.4 | 1630 | 250 | 300 | 4100 | 606.5 | 148 | 0.799 | −45 | 597 | 3963 | X |
| Comp. Ex. 3 | 2.2 | 1630 | 250 | 300 | 4100 | 606.5 | 148 | 1.256 | −30 | 537 | 3210 | X |
| Comp. Ex. 4 | 1.8 | 1630 | 250 | 300 | 4100 | 606.5 | 198 | 1.027 | −45 | 621 | 3207 | X |
| Comp. Ex. 5 | 2.2 | 1630 | 250 | 300 | 4100 | 606.5 | 198 | 1.256 | −45 | 508 | 2147 | X |
| Comp. Ex. 6 | 1.4 | 1630 | 250 | 306 | 4100 | 606.3 | 98 | 0.799 | −45 | 395 | 2624 | X |
| Comp. Ex. 7 | 1.8 | 1630 | 250 | 300 | 500 | 606.5 | 148 | 1.027 | −30 | 657 | 4795 | X |
| Comp. Ex. 8 | 1.8 | 1630 | 250 | 300 | 5000 | 606.5 | 148 | 1.027 | −30 | 657 | 4795 | X |
| Comp. Ex. 9 | 1.4 | 1630 | 300 | 300 | 4500 | 606.5 | 148 | 0.959 | −30 | 407 | 3185 | X |
| Comp. Ex. 10 | 1.4 | 1630 | 300 | 350 | 500 | 606.5 | 148 | 0.959 | −30 | 647 | 5058 | X |

In each Example 1, 2, 4, 5, 6, 7, 8, 9, 11, 13, 14, 15, 18, 20, 21, 23 and 24, the magnetic flux density of the electromagnetic brake was within a proper range, and a funnel mold was used. As shown in these Examples, it was confirmed that the quality of coils in every Example was excellent ◎ when the magnetic flux density of the electromagnetic brake was within a proper range and a funnel mold was used, without any influence of other casting conditions (the casting speed, the casting width, the thickness of an expanding part of a funnel portion, and the conditions of the immersion nozzle).

In each Example 3 and 26, the magnetic flux density of the electromagnetic brake was within a proper range but a rectangular mold without a funnel portion was used. The quality of coils under this condition was good ○.

En each Example 10, 17, 19 and 27, a funnel mold was used, the magnetic flux density of the electromagnetic brake was within a proper range, and the casting speed was low. The quality of coils under this condition was good ○ in every Example.

In Example 22, a funnel mold was used, the magnetic flux density of the electromagnetic brake was within a proper range, and the casting speed was high. The quality of coils under this condition was good ○.

In Example 25, a funnel mold was used and the magnetic flux density of the electromagnetic brake was within a proper range with a slight outlet flow angle (−5°). The quality of coils under this condition was good ○.

In each Comparative Example 1 to 10, the magnetic flux density of the electromagnetic brake was not within a proper range. The quality of coils under this condition was poor x in every Example.

In each Comparative Example 7 and 8 and Example 12 to 16, conditions other than the magnetic flux density of the electromagnetic brake were standardized, and a proper range of the magnetic flux density of the electromagnetic brake according to the above described (Formula 1) was 657 to 4795 (Gauss).

In each Example 13 to 15, the magnetic flux density of the electromagnetic brake was within a proper range and remote from both upper and lower limits. It was confirmed that the quality of coils in every Example was excellent ◎.

In Comparative Example 7, the magnetic flux density of the electromagnetic brake was lower than the lower limit of a proper range in 24%. In Comparative Example 8, the magnetic flux density of the electromagnetic brake was higher than the upper limit of a proper range in 4%. The quality of coils in every Example was poor x.

In Example 12 where a funnel mold was used, the magnetic flux density of the electromagnetic brake was within a proper range and close to the lower limit compared with the density in each Example 13 to 15. The quality of coils under this condition was good ○.

In Example 16 where a funnel mold was used, the magnetic flux density of the electromagnetic brake was within a proper range and close to the upper limit compared with the density in each Example 13 to 15. The quality of coils under this condition was good ○.

REFERENCE SIGNS LIST

1 . . . mold
2 . . . immersion nozzle
3, 3*a*, 3*b* . . . long side wall
4 . . . electromagnetic brake device
5 . . . outlet port
6 . . . outlet flow
7*a*, 7*b* . . . short side wall
8 . . . solidified shell
9 . . . center of an electromagnetic brake coil

The invention claimed is:

1. A method for continuously casting steel, the method comprising supplying molten steel into a mold while applying an electromagnetic brake to an outlet flow discharged from an outlet port of an immersion nozzle, wherein magnetic flux density (B) of the electromagnetic brake is within a range of the following (Formula 1), and a funnel mold with short sides and long sides on a horizontal cross-section, in which a distance between the long sides facing each other in the mold at a middle of each long side is enlarged than a distance between the long sides at ends of the long sides, is used as the mold:

$$B_{min} \leq B \leq B_{max} \quad \text{(Formula 1)}$$

wherein $$B_{min} = \frac{800 \cdot \left(\frac{D_{max}}{D_0}\right)^3 \cdot \left(\frac{H_{SEN}}{H_0}\right)}{|(v \cdot \sin\theta)|},$$

$$B_{max} = \frac{3000 \cdot \left(\frac{D_{max}}{D_0}\right)^3 \cdot \left(\frac{H_{SEN}}{H_0}\right)}{(v \cdot \sin\theta)^2},$$

$D_0$=a mold thickness (m) of the mold having short sides and long sides on a horizontal cross-sectional shape, the mold thickness measured as a distance between the long sides facing each other in the mold at ends of the long sides, $D_{max}$=a maximum value of a mold thickness (m) of the mold having the short sides and the long sides on the horizontal cross-sectional shape, the maximum value measured as a distance between the long sides facing each other in the mold at a middle of each long side, $H_0$=a distance (m) between a surface of the molten steel and a center of an electromagnetic brake coil in a vertical direction, $H_{SEN}$=a distance (m) between a bottom surface of the immersion nozzle and the center of the electromagnetic brake coil in the vertical direction, v=a flow velocity (m/s) of the molten steel discharged from the immersion nozzle, and θ=an outlet flow angle (°) of the molten steel, wherein the flow velocity v of the molten steel is 0.441 m/s to 1.256 m/s.

2. The method for continuously casting steel according to claim 1, wherein $D_{max}/D_0$ is 1.16 to 1.24.

3. The method for continuously casting steel according to claim 1, wherein $H_{SEN}/H_0$ is 0.161 to 0.327.

4. The method for continuously casting steel according to claim 1, wherein the outlet flow angle θ of the molten steel is −45° to −5°.

* * * * *